United States Patent [19]

Hood, Jr. et al.

[11] Patent Number: 4,856,303

[45] Date of Patent: Aug. 15, 1989

[54] AGITATOR THRUST SPACER FOR AUTOMATIC WASHER

[75] Inventors: Richard D. Hood, Jr.; Dale E. Mueller, both of Benton Township, Berrien County; Douglas J. Walker, Lake Township, Berrien County, all of Mich.

[73] Assignee: Whirlpool Corporation, Benton Harbor, Mich.

[21] Appl. No.: 222,029

[22] Filed: Jul. 21, 1988

[51] Int. Cl.[4] ..... D06F 37/40

[52] U.S. Cl. ..... 68/133; 68/134; 74/126; 74/577 SF; 192/35; 192/46

[58] Field of Search ..... 68/133, 134; 74/126, 74/577 SF; 192/35, 46

[56] References Cited

U.S. PATENT DOCUMENTS

| | | | |
|---|---|---|---|
| 3,388,570 | 6/1968 | Cobb et al. | 68/134 |
| 3,503,086 | 3/1970 | Mason et al. | 68/134 |
| 3,511,067 | 5/1970 | Matzen | 68/134 X |
| 3,987,052 | 10/1976 | Ruble | 68/134 |
| 4,719,769 | 1/1988 | Pielemeier et al. | 68/133 |

*Primary Examiner*—Frankie L. Stinson

*Attorney, Agent, or Firm*—Hill, Van Santen, Steadman & Simpson

[57] ABSTRACT

A thrust spacer having resilient, upwardly angled tabs is provided to act as a variable spacer within a two-piece agitator, between an upper agitator portion and a lower agitator portion to prevent relative vertical movement between the two portions while permitting relative rotational movement therebetween. Each of the tabs is positioned adjacent to an opening larger than the tab to permit the tab to be compressed into the opening to provide a large degree of variability in the height of the tabs. The spacer also includes angled arms which engage with slots in the lower agitator portion to cause the spacer to rotate with the lower agitator portion.

10 Claims, 2 Drawing Sheets

AGITATOR THRUST SPACER FOR AUTOMATIC WASHER

BACKGROUND OF THE INVENTION

The present invention relates generally to a thrust spacer positioned between two relatively rotating parts and more particularly to a thrust spacer used within an agitator in an automatic washer.

A one way clutch mechanism for a dual action agitator is disclosed in U.S. Pat. No. 4,719,769 assigned to the assignee of the present invention. In that patent, oscillatory motion of a drive shaft is translated into unidirectional intermittent rotary motion of an upper agitator part through the use of a one-way clutch mechanism. The upper agitator part is rotatingly carried a the lower agitator part which oscillates with the drive shaft. The lower agitator part is fastened directly to an extension of the drive shaft by a bolt which also clampingly captures a cam forming a part of the clutch. The upper agitator part has an interior annular mounting ring 52 which merely rests on a bearing surface of the lower agitator part, but is not otherwise held vertically in place. The cam is spaced vertically above the mounting ring which permits some vertical movement of the upper agitator portion. It is of course necessary that the upper agitator portion not be firmly clamped because it must rotate relative to the lower agitator portion in order to provide the desired function. Further, due to manufacturing tolerances, it cannot be assured that there will be no vertical play of the upper agitator part support ring between the lower agitator part bearing surface and the cam. The vertical movement possible by the upper agitator does cause some excessive wear on the cam and also causes a chattering as the upper agitator part bounces vertically during an agitate portion of the wash cycle. Therefore, it would be advantageous if a means were provided to prevent vertical movement of the upper agitator part while still permitting relative rotary motion between the upper agitator part and the lower agitator part.

SUMMARY OF THE INVENTION

It is an object of the present invention to provide an expandable means for completely filling, in at least one dimension, a gap between two relatively rotatable parts so as to prevent or inhibit movement between those parts in the dimension filled while permitting relative motion therebetween in a different dimension.

Further, it is an object of the present invention to provide a means for preventing free vertical movement between an upper agitator portion and a lower agitator portion in a dual action agitator while still permitting relative rotary motion about a vertical axis between the two agitator parts.

It is an additional object of the invention to provide a device for filling the vertical space between the lower agitator bearing surface and the cam not occupied by the upper agitator part support ring, which device compensates for manufacturing variations in the parts sizes within acceptable tolerance levels.

It is a still further object of the invention to provide a thrust spacer between the support ring on the upper agitator portion and the bearing surface on the lower agitator portion, which thrust spacer substantially fills the vertical space between the support ring and bearing surface and provides a bias against the support ring to urge it into firm contact with a bearing surface of the cam member.

These and other objects are achieved by the present invention, where, in a preferred embodiment of the invention, a thrust spacer is provided in the form of a ring having a cylindrical sidewall and an outwardly extending flange-type top wall, the top wall being positioned in the gap between the upper bearing surface of the lower agitator portion and the lower surface of the upper agitator portion support ring. The top flange wall portion of the thrust spacer has a plurality of tabs bent upwardly therefrom which are formed of the same material as the thrust spacer, preferably a plastic material such as DuPont Delren II, which is resilient, thus providing a spring force to the tabs and therefore being an expandable means to fill the gap between the two relatively moving parts. The tabs are formed to have a natural height greater than the maximum space between the bearing surface of the lower agitator portion and the support ring when the support ring is held up against the clutch cam at a maximum tolerance variance, so that the tabs will be maintained in a slightly compressed state, to continuously bias the support ring against the clutch cam.

The thrust spacer is concentrically positioned on the lower agitator portion by the cylindrical sidewall and is held against rotation relative to the lower agitator portion by a plurality of arms which extend upwardly and outwardly from the thrust spacer cylindrical wall to support the top flange wall. These support arms are received within slots in the lower agitator portion and therefore the thrust spacer rotates with the lower agitator portion.

DETAILED DESCRIPTION OF THE PREFERRED EMBODIMENTS

The present invention finds particular utility in a two-piece vertical agitator, although the invention is not limited to such an embodiment and environment. However, to provide a detailed description of the invention, it will be disclosed in the form of this particular embodiment.

Figure 1:
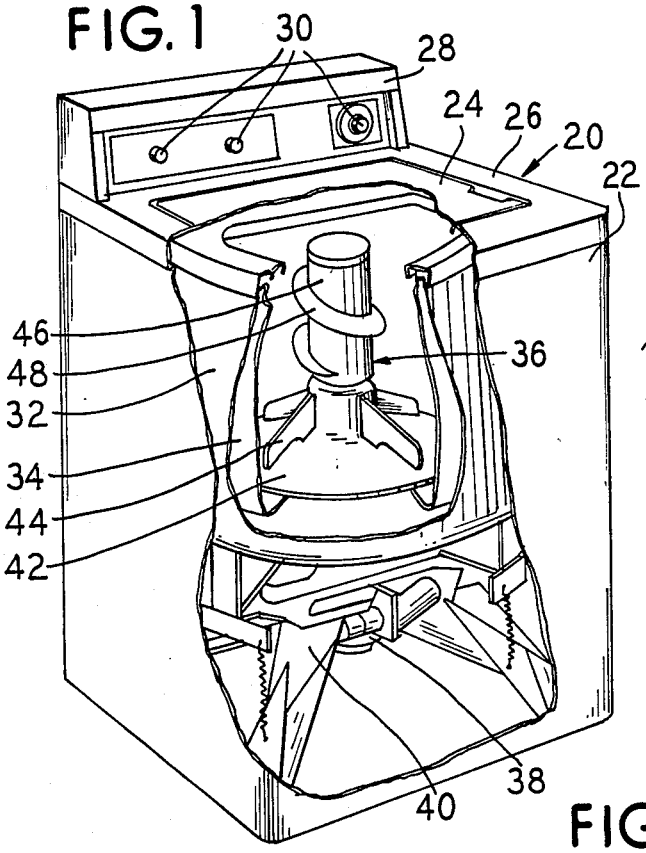
FIG. 1 is a perspective view of a washing machine, partially cut away to illustrate a dual-action agitator utilizing a one-way clutch mechanism and thrust spacer incorporating the principles of the present invention.

In FIG. 1 there is a shown an automatic washing machine generally at 20 including a cabinet 22 having an openable door 24 in a top panel 26 thereof and a control console 28 along a back portion thereof including a plurality of presetable controls 30 for automatically controlling selected laundering cycles having washing, rinsing and drying periods in a program. A washing tub 32 is mounted within the basket 22 and includes an interior perforate basket 34 forming a treatment zone and a dual action agitator 36 driven by a motor and transmission 38 all of which is mounted on a support frame 40. The agitator 36 includes a lower portion 42 having a skirt 43 and radial fins 44 and an upper portion 46 in the form of a barrel having an auger-like vane 48 helically arranged at an exterior surface thereof.

Figure 6:
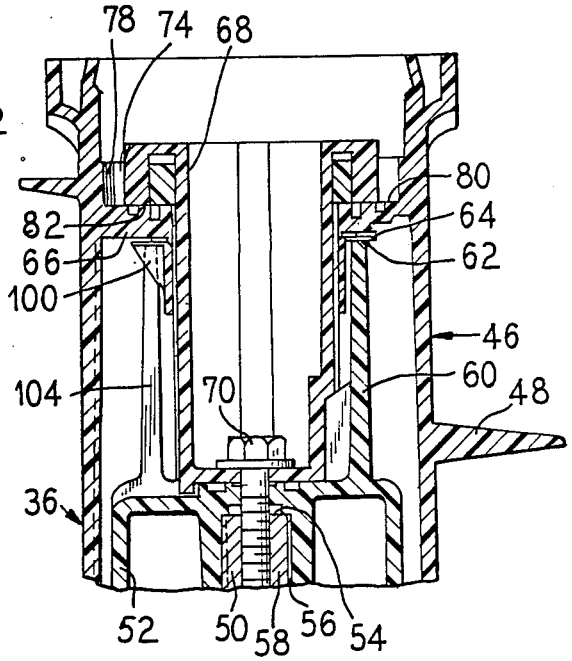
FIG. 6 is an enlarged sectional view of the clutch and thrust spacer portion within the agitator.
Figure 2:
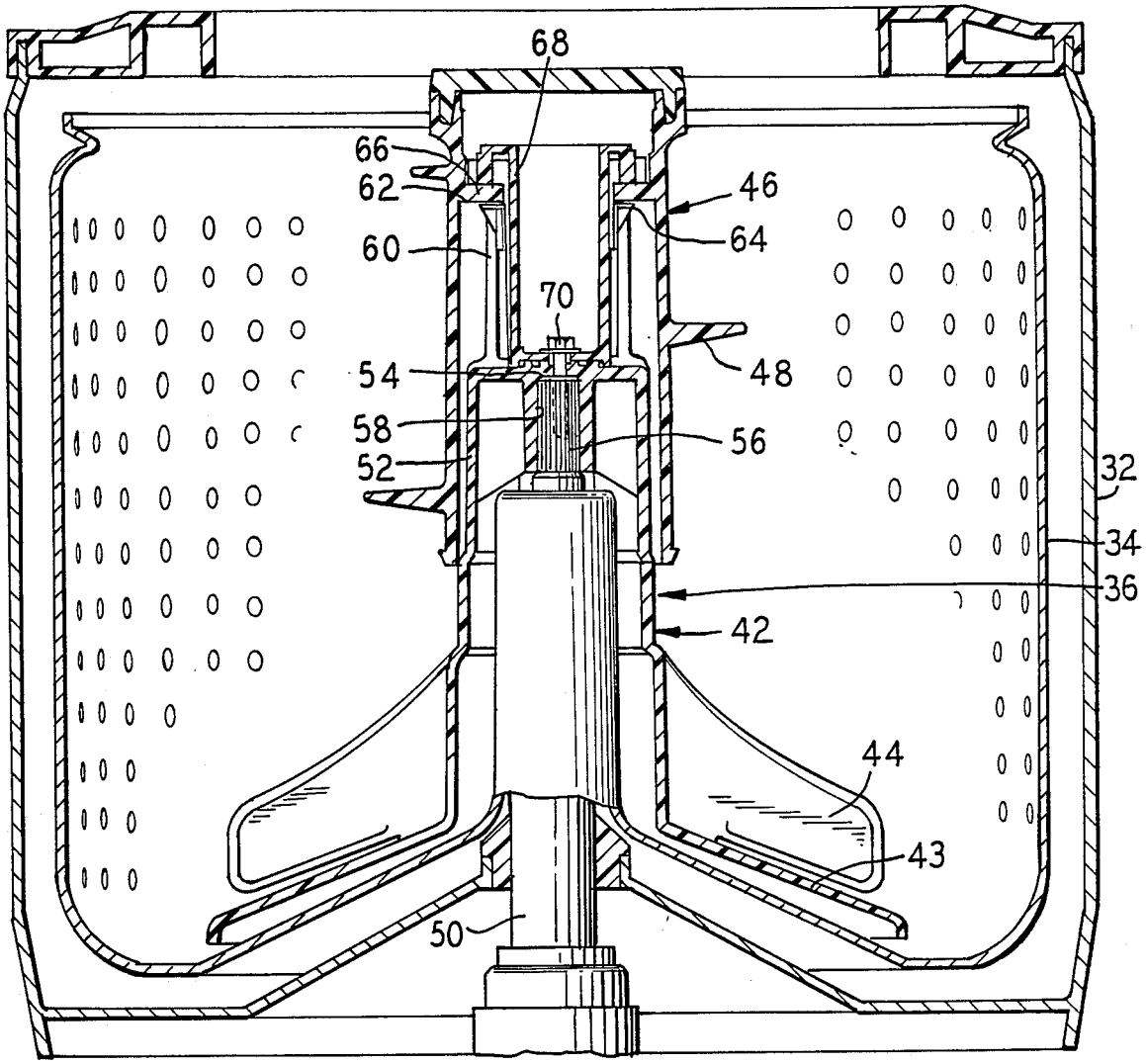
FIG. 2 is a cross section through the tub, basket and agitator of the washing machine shown in FIG. 1 to illustrate the particulars of the clutch mechanism and agitator thrust spacer.

As seen in greater detail in FIGS. 2 and 6 a drive shaft 50 extends upwardly from the motor into the center of the wash tub 32 and the perforate basket 34 to support and drive the agitator 36. The lower agitator portion 42 has a vertical cylindrical portion 52 on which the upper agitator barrel 46 is mounted. An upper end 54 of the drive shaft 50 includes a splined connector 56 on which is mounted a splined opening 58 that is formed in the lower agitator portion 42. The lower agitator portion 42 has a top cylindrical extension 60 which extends upwardly within the upper agitator portion 46 and which terminates in a top bearing surface 62. A thrust spacer 64 incorporating the principles of the present invention is placed over the top of the cylindrical extension 60. The upper agitator portion 46 is fitted over the cylindrical walls 60 and 52 of the lower agitator portion 42 and is supported by an interior annular support ring 66 which rests on the top of the agitator thrust spacer 64. The upper agitator portion 46, thus, is rotatable independently of the lower agitator portion 42.

Figure 3:
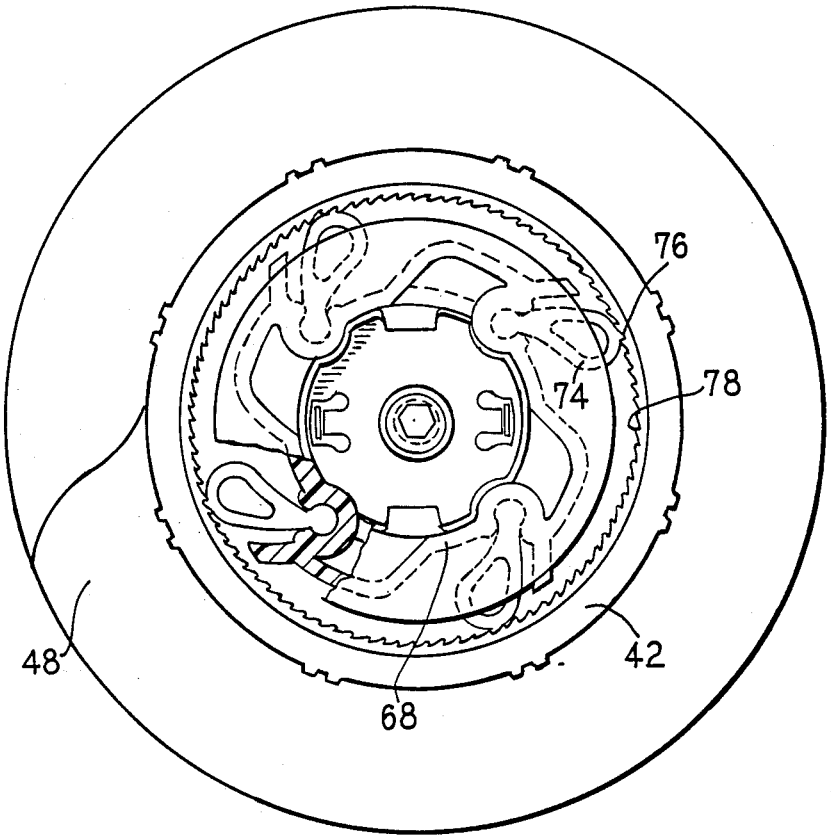
FIG. 3 is a cross section through the upper agitator barrel in FIG. 2 along lines III—III to show the one-way clutch.
Figure 4:
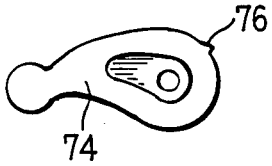
FIG. 4 is an enlarged plan view of an individual dog of the one-way clutch.
Figure 5:
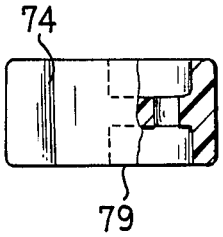
FIG. 5 is an elevational view, partially in cross section of the dog shown in FIG. 4.

A clutch mechanism substantially similar to that described in U.S. Pat. No. 4,719,769 is used to provide unidirectional rotation of the upper agitator portion 46 by means of oscillatory input from the drive shaft 50. The description of the clutch mechanism of U.S. Pat. 4,719,769 is incorporated herein by reference and will be briefly described as follows:

A cam member 68 is fastened to the lower agitator portion 42 by means of a bolt 70 clamping the cam 68 and the lower agitator portion 42 together between the bolt head and the upper end of the drive shaft 50. An upper portion of the drive cam 68 extends radially outwardly and downwardly over the support ring 66 of the upper agitator portion 46. As seen in FIGS. 3 and 6, the cam 68 carries a plurality of dogs 74 (FIGS. 4 and 5) in a pivotal manner, each of the dogs having a tooth 76 formed thereon, the tooth being engagable with a row of teeth 78 formed on an interior surface of the upper agitator portion 46. As the drive shaft 50 rotates in a clockwise direction as shown in FIG. 3, the teeth of the dogs engage wi±h the teeth 78 of the upper agitator portion and cause the upper agitator portion to rotate. When the drive shaft 50 rotates in the counter-clockwise direction, the dogs pivot in the cam such that the teeth 76 of the dogs move away from the teeth 78 of the upper agitator portion 46 and permit the lower agitator portion to rotate relative to the upper agitator portion which in turn remains stationary relative to the washer. A bottom surface 79 of each dog lies on an upper surface 80 of the support ring 66. The upper surface 80 also rides against a lower bearing surface 82 of the cam 68.

Figure 7:
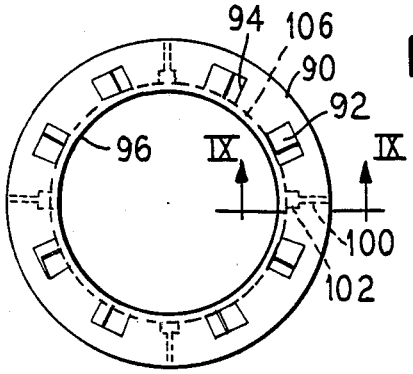
FIG. 7 is a plan view of the thrust spacer incorporating the principles of the present invention.
Figure 8:
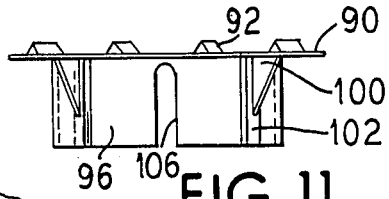
FIG. 8 is a side elevational view of the thrust spacer of FIG. 7.
Figure 10:
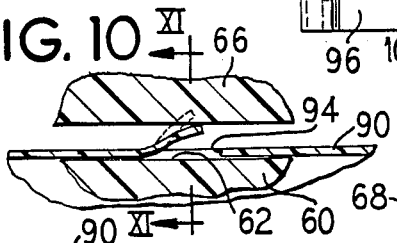
FIG. 10 is a side sectional view of the thrust spacer in place between the lower agitator portion and the upper agitator portion.
Figure 11:
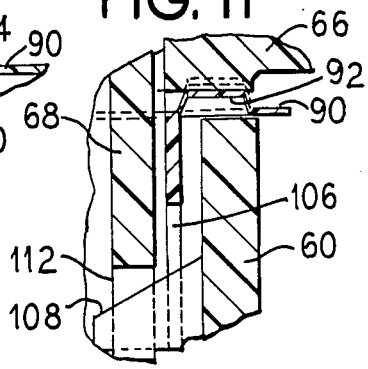
FIG. 11 is a sectional view of the thrust spacer taken generally along the XI—XI of FIG. 10.
Figure 9:
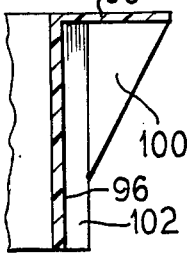
FIG. 9 is a partial side elevational view of the thrust spacer taken generally along the line IX—IX of FIG. 7.

The thrust washer 64 is provided to prevent vertical motion of the upper agitator portion 46 by filling all of the vertical space between the lower agitator bearing surface 62 and the lower bearing surface 82 of the cam 68 not occupied by the support ring 66. The thrust washer 64 is positioned between the lower agitator bearing surface 62 and the support ring 66 (FIGS. 10 and 11) thus urging the support ring up against the bearing surface 82 of the cam. As best seen in FIGS. 7–9, the thrust spacer is in the form of a ring having a top flange wall 90 with a plurality of tabs 92 projecting upwardly therefrom, the tabs being integrally formed at one end with the flange and each tab 92 overlying an opening 94 at least equal in size to the tab. The tabs 92 are formed to project upwardly to a height greater than a maximum vertical spacing within maximum tolerance levels between the lower agitator portion 42 and the support ring 66 (FIGS. 10 and 11) so that a restoring spring force of the tabs will continuously urge the upper agitator portion upwardly against the bearing surface 82 of the cam 68. The openings 94 in the flange wall 90 permit the flanges to be compressed into a position planar with the flange in a minimum clearance situation within acceptable tolerance levels.

The thrust spacer also includes a cylindrical wall 96 which depends downwardly from the flange. The cylindrical wall fits between the upper cylinder portion 60 of the lower agitator portion and the cam 68 to ensure concentricity of the spacer on the lower agitator bearing surface 62.

To keep the thrust spacer from rotating, a plurality of diagonal arms 100 are provided which extend from the top flange 90 to ribs 102 extending the vertical height of the side wall 96. The angled arms 100 are received in slots 104 (FIG. 6) in the cylindrical extension 60 of the lower agitator portion 42 and thus the thrust spacer is caused to rotate with the lower agitator portion.

The cylindrical wall 96 of the thrust spacer also has a pair of opposed vertical slots 106 which provide clearance for a pair of diametrically opposed inwardly projecting ribs 108 (FIG. 11) formed on an interior surface of the cylindrical extension 60 of the lower agitator part, which ribs also extend into slots 112 of the cam 68 to further ensure that the cam and thrust spacer will rotate with the lower agitator portion 42.

Thus, it is seen that the present invention provides an expandable means, in the form of a thrust spacer with flexible angularly upstanding tabs, for completely filling that part of a vertical gap or space in a second part, being the space between the overlying cam portion and the lower agitator bearing surface, not already filled by a first part, being the support ring of the upper agitator portion, while permitting relative rotational motion between the parts.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic washer, a two-piece vertical agitator comprising:

a lower agitator portion having an upper bearing surface;

an upper agitator portion partially surrounding said lower agitator portion and having an inwardly extending support ring carried on said bearing surface of said lower agitator portion;

a one-way clutch mechanism connecting said upper and lower portions to permit relative rotation between said two portions;

said clutch mechanism having a cam member secured to said lower agitator portion to rotate therewith, a portion of said cam member overlying and spaced from said bearing surface of said lower agitator portion to form a vertical space therebetween partially filled by said support ring of said upper agitator portion; and a thrust spacer interposed between said lower agitator portion bearing surface and said upper agitator portion support ring;

said thrust spacer having a plurality of resilient tabs angularly upstanding therefrom to substantially fill said vertical space not already filled by said support ring.

2. A two-piece vertical agitator according to claim 1, wherein said lower agitator portion bearing surface is annular in shape and said thrust spacer is in the form of a ring with a top flange wall which rests on said bearing surface and a cylindrical side wall which surrounds said bearing surface and centers said thrust spacer on said lower agitator portion.

3. A two-piece vertical agitator according to claim 2 including means for interconnecting said thrust spacer with said lower agitator portion to cause co-rotation of said spacer and said lower agitator portion.

4. A two-piece vertical agitator according to claim 3, wherein said means for interconnecting comprises angled arm members extending from said cylindrical wall to said top flange wall on said thrust spacer and slots for receiving said arms formed in said lower agitator portion.

5. A two-piece agitator according to claim 1, wherein said tabs are joined at one end to said thrust spacer and openings are provided in said thrust spacer adjacent to each of said tabs being large enough to receive each of said tabs in the event free ends of said tabs are pressed towards said thrust spacer.

6. A thrust spacer for use in a two-piece vertical agitator wherein a lower agitator portion has an annular bearing surface at a cylindrical top end, an upper agitator has an internal support ring sized to rest on said annular bearing surface to permit relative rotational movement between said upper and lower agitator portions, and a clutch mechanism is secured to rotate with said lower agitator portion and has a connection with said upper agitator portion to impart torque to said upper agitator portion in one rotational direction, said clutch mechanism including a cam member having a portion which overlies said upper agitator portion support ring when said agitator and clutch mechanism are assembled comprising:

a ring-shaped member having an annular top flange wall extending horizontally and a vertical cylindrical wall depending therefrom, said flange wall being sized to lie on said lower agitator portion bearing surface and said cylindrical wall being sized to surround said top end of said lower agitator portion;

said flange wall having a plurality of angularly upstanding tabs formed thereon, upper ends of said tabs engagable with said upper agitator portion support ring to urge said ring upwardly against said cam member to inhibit vertical movement of said upper agitator portion upon assembly of said agitator and clutch mechanism.

7. A thrust spacer according to claim 6, including means for interconnecting said thrust spacer with said lower agitator portion to cause corotation of said spacer and said lower agitator portion.

8. A thrust spacer according to claim 7, wherein said means for interconnecting comprises angled arm members extending from said cylindrical wall to said top flange wall on said thrust spacer to extend into slots formed in said lower agitator portion.

9. A thrust spacer according to claim wherein said means for interconnecting further comprises vertical slots formed in said thrust spacer vertical wall to receive inwardly extending tabs formed on said agitator portion.

10. A thrust spacer according to claim 6, wherein said tabs are joined at one end to said flange wall and openings are provided in said flange wall adjacent to each of said tabs being large enough to receive each of said tabs in the event free ends of said tabs are pressed toward said thrust spacer.

* * * * *